US008082829B2

(12) United States Patent
Rummel et al.

(10) Patent No.: US 8,082,829 B2
(45) Date of Patent: Dec. 27, 2011

(54) LIFT ASSIST FOR A FOOD PRODUCT SLICER

(75) Inventors: Samuel A. Rummel, Pooler, GA (US); Guangshan Zhu, Richmond Hill, GA (US); Shiyu Chen, Richmond Hill, GA (US); Shahram Shariff, Savannah, GA (US)

(73) Assignee: Premark FEG L.L.C., Wilmington, DE (US)

( * ) Notice: Subject to any disclaimer, the term of this patent is extended or adjusted under 35 U.S.C. 154(b) by 581 days.

(21) Appl. No.: 12/281,365

(22) PCT Filed: Mar. 2, 2007

(86) PCT No.: PCT/US2007/063137

§ 371 (c)(1), (2), (4) Date: Sep. 2, 2008

(87) PCT Pub. No.: WO2008/036427

PCT Pub. Date: Mar. 27, 2008

(65) Prior Publication Data

US 2009/0007745 A1 Jan. 8, 2009

Related U.S. Application Data

(60) Provisional application No. 60/783,123, filed on Mar. 16, 2006.

(51) Int. Cl.
*B26D 7/22* (2006.01)

(52) U.S. Cl. ..... 83/703; 83/730

(58) Field of Classification Search ..... 83/703, 83/729, 730, 932; 108/144.11, 145, 147, 108/147.19, 147.2, 147.22; 248/123.2, 125.2, 248/550, 631, 649; 254/122, 124, 126, 423
See application file for complete search history.

(56) References Cited

U.S. PATENT DOCUMENTS

| | | | | |
|---|---|---|---|---|
| 2,449,850 | A * | 9/1948 | Huhle | 254/424 |
| 2,604,299 | A * | 7/1952 | White | 254/100 |
| 2,725,997 | A * | 12/1955 | Shvetz | 414/427 |
| 2,870,851 | A * | 1/1959 | De La Parra Clark | 180/201 |
| 5,245,898 | A * | 9/1993 | Somal et al. | 83/58 |
| 7,073,421 | B1 * | 7/2006 | Verhalen et al. | 83/174 |
| 7,207,764 | B1 * | 4/2007 | Snook | 414/427 |
| 7,334,804 | B2 * | 2/2008 | Mitchell et al. | 280/79.4 |
| 2007/0266912 | A1 * | 11/2007 | Swain | 108/145 |

OTHER PUBLICATIONS

PCT, International Search Report and Written Opinion, PCT/US2007/063137 (Apr. 15, 2008).
PCT, International Preliminary Report on Patentability, PCT/US2007/063137 (Sep. 25, 2008).

* cited by examiner

*Primary Examiner* — Edward Landrum
(74) *Attorney, Agent, or Firm* — Thompson Hine LLP

(57) ABSTRACT

A food product slicer includes a base, a knife mounted for rotation relative to the base and a carriage mounted to the base for reciprocal movement back and forth past a cutting edge of the knife. A lift assist assembly is associated with the base and arranged to push the slicer upward toward an upward tilted position, the lift assist assembly arranged for reducing user input energy required to tilt the slicer upward.

7 Claims, 5 Drawing Sheets

LIFT ASSIST FOR A FOOD PRODUCT SLICER

CROSS-REFERENCES

This application claims the benefit of U.S. provisional application Ser. No. 60/783,123, filed Mar. 16, 2006.

TECHNICAL FIELD

The present application relates generally to food product slicers of the type commonly used to slice bulk food products and, more particularly, to a lift assist system for a food product slicer.

BACKGROUND

Typical reciprocating food slicers have a rotatable, circular or disc-like slicing blade, an adjustable gauge plate for determining the thickness of the slice and a carriage which is mounted on a slide rod within the slicer base or housing for supporting the food as it is moved back and forth past the cutting edge of the knife during slicing. A lift mechanism (lifting lever and roller) is provided to assist a user in lifting the front feet of the slicer to enable the user to clean the area underneath the slicer. Although the lift mechanism reduces the lifting force, the energy input or total effort required to lift the slicer is not reduced. This is due to the length of the lift lever and the distance required to rotate the lever to lift the slicer. In addition, the lift lever is typically outside of the slicer's footprint which creates problems for packaging the slicer and sometimes gets in the way of the user.

It would be desirable to provide a lift assist system that reduces the total energy and effort required to lift a slicer. It would also be desirable to provide such a system without increasing the slicer's footprint.

SUMMARY

In one aspect, a food product slicer includes a base, a knife mounted for rotation relative to the base and a carriage mounted to the base for reciprocal movement back and forth past a cutting edge of the knife. A lift assist assembly is associated with the base and arranged to push the slicer upward toward an upward tilted position, the lift assist assembly arranged for reducing user input energy required to tilt the slicer upward.

DESCRIPTION

Figure 1:
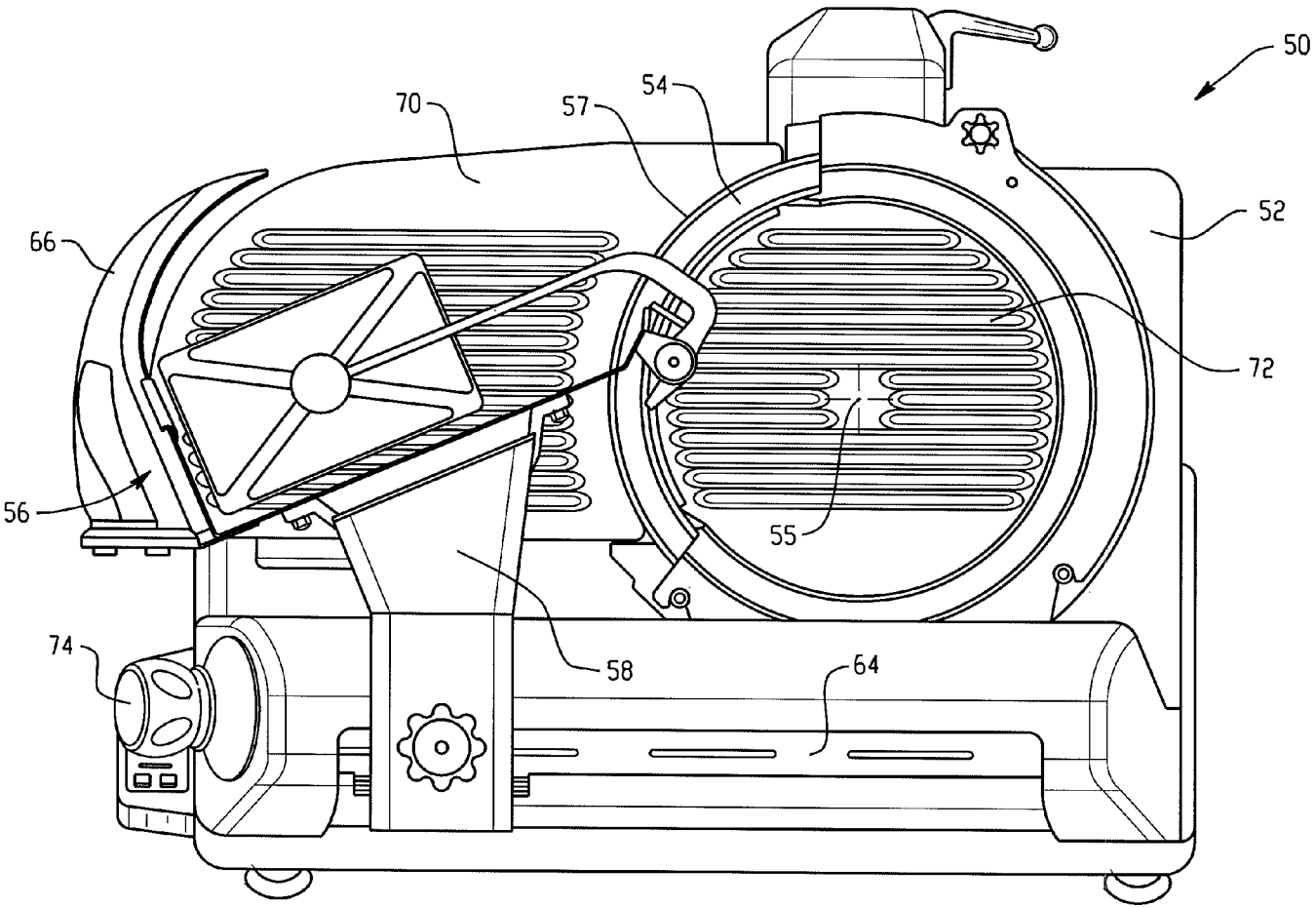
FIG. 1 is side elevation of a food product slicer.

Referring to FIG. 1, a food product slicer 50 includes a housing or base 52 and a circular, motor-driven slicing knife

54 that is mounted to the housing for rotation about an axis 55. The left side of FIG. 1 is generally referred to as the front side of the slicer (which is where an operator stands for slicing), the right side of FIG. 1 is generally referred to as the rear side of the slicer and FIG. 1 depicts a right side view of the slicer. A food product can be supported on a manually operable food carriage 56 which moves the food product to be sliced past the cutting edge 57 of the rotating slicing knife 54. The food carriage 56 reciprocates from left to right relative to FIG. 1, along a linear path so that the lower end of the bulk food product slides along the surface of the gauge plate 70, is cut by the knife 54 and then slides along a knife cover plate 72. Food carriage 56 includes a tray mounted on a tray arm 58 that orients the food carriage tray at the appropriate angle (typically perpendicular) to the cutting edge plane. The food carriage reciprocates in a slot 64 at a lower portion of the housing 52 and a handle 66 is mounted to the food carriage 56. The handle is graspable by a user and can be used to manually move the food carriage. The carriage may also be automatically driven (e.g., as by a motor drive or other prime mover). A handle 74 for adjusting the gauge plate to control slice thickness is also shown.

Figure 2:
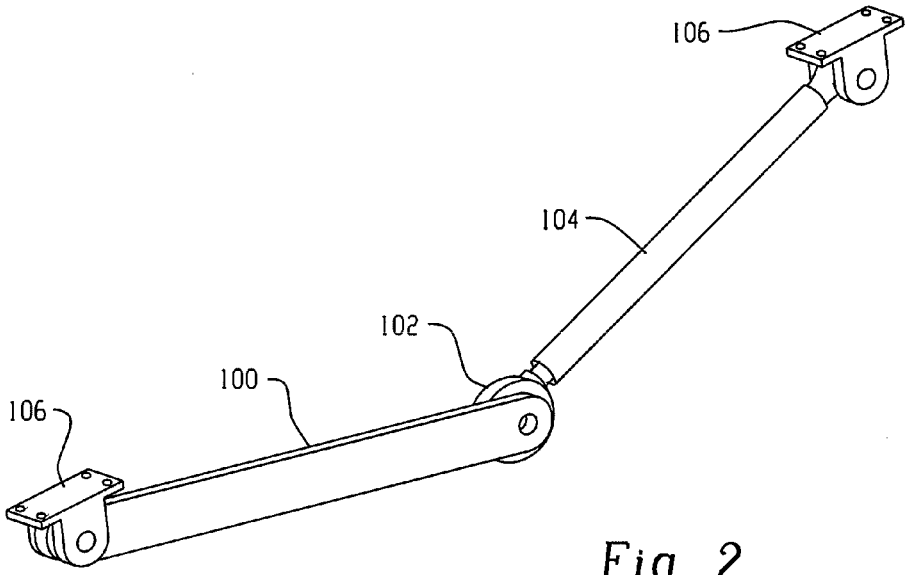
FIG. 2 is a perspective of one embodiment of a lift assist assembly when in a non-extended condition.
Figure 3:
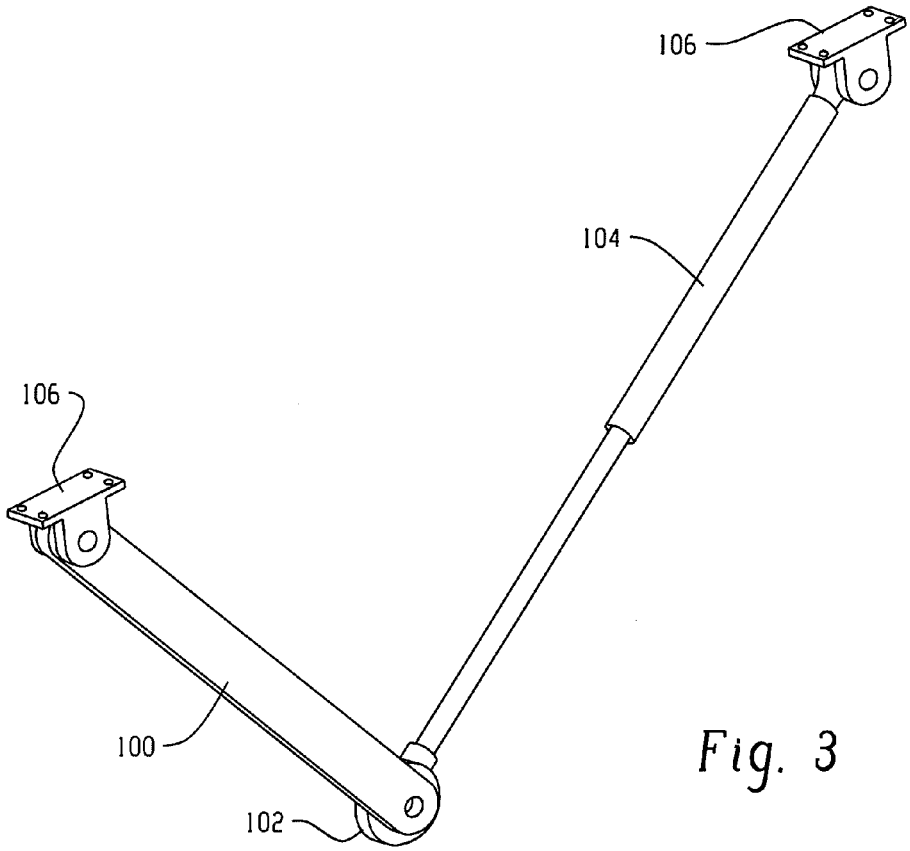
FIG. 3 is a perspective of the lift assist assembly of FIG. 2 when in an extended condition.

Referring to FIGS. 2 and 3, a lift assist includes a linkage bar 100, a roller 102, a gas spring 104 and first and second mounting brackets 106. The mounting brackets 106 may be fixed to the underside of the slicer base, or an internal portion of the base, or may be formed unitary with the base. One end of the linkage bar 100 is pivotally connected to one bracket and the other end is pivotally connected with the roller 102. Likewise, one end of the gas spring 104 is pivotally connected to the other bracket and the other end is pivotally connected with the roller 102. The pivot connections to the roller 102 are made on a common axis. The lift assist assembly is positioned toward one side of the slicer, in this case toward the side of the slicer that includes the carriage arm slot 64, which is the right side of the slicer as determined from an operator standing at the front side of the slicer.

Figure 4:
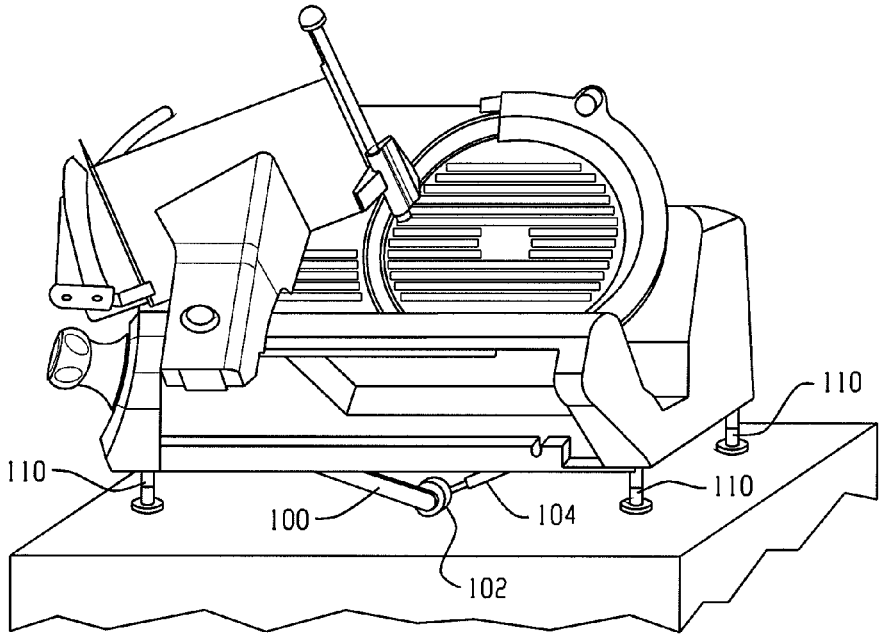
FIG. 4 is a perspective view of a slice when resting in a horizontal, operating position.
Figure 5:
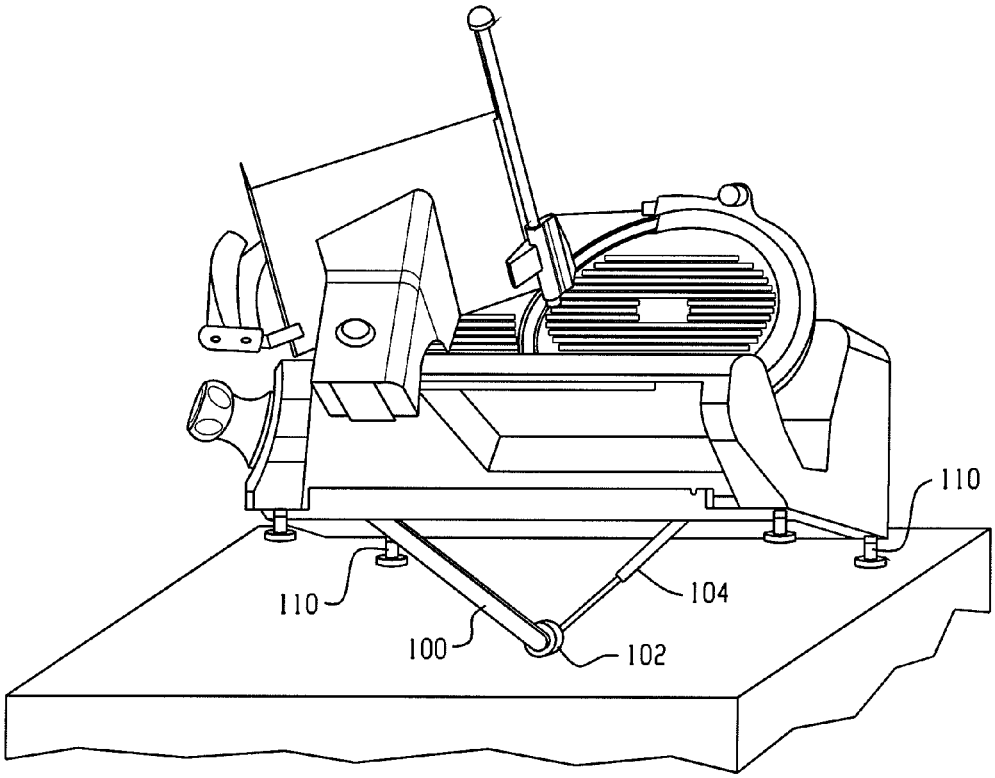
FIG. 5 is a perspective view of a slicer when tilted upward, showing the lift assist assembly in extended condition.
Figure 6:
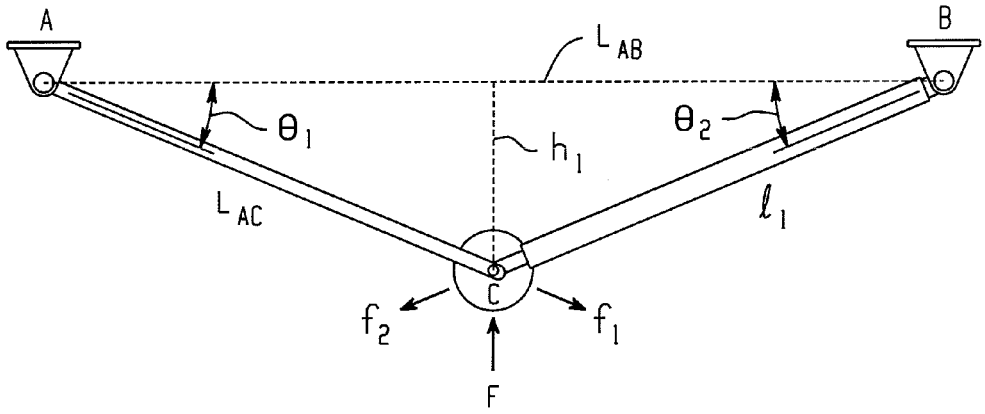
FIG. 6 is a diagrammatic view of the lift assist assembly.

The slicer can move between a down/lowered position shown in FIG. 4, in which the slicer is primarily supported on all four support legs 110, and a up/raised position shown in FIG. 5, in which the slicer is supported on its left two support legs 110 and the lift assist assembly. To clean the area underneath the slicer, the user lifts the slicer base upward on the slotted side of the base. The gas spring exerts an upward force on the slicer as well to assist the user. The amount of assist provided by the gas spring will vary during the lifting of the slicer due to the change in the angle of the linkage bar 100 and the gas spring 104. Specifically, the assist provided by the arrangement increases during raising of the slicer as may be evaluated by reference to the following basic equations and FIG. 6. The upward lifting force provided by one embodiment of the lift assist assembly can be determined as:

$$F=f_1 \sin \theta_1+f_2 \sin \theta_2. \quad \text{Eq. 1}$$

In the foregoing equation, $f_2$ is defined by the spring force of the gas spring, and f1 is defined as:

$$f_1=f_2 \cos \theta_2/\cos \theta_1. \quad \text{Eq. 2}$$

$L_{AB}$ and $L_{AC}$ are fixed lengths and $1_1$ will vary as the gas spring extends or retracts.

Using the foregoing equations the lift assist assembly can be arranged to achieve lift assisting effect as desired. In one implementation, the linkage 100 and gas spring 104 are selected and arranged so that once the slicer passes a selected neutral position, it will continue move up (automatically) until it reaches the up position. The neutral position may be selected as about one half of the fully raised height of the slicer, though other variations are possible. In order to return the slicer to its original position, the user pushes down on the slicer, working against the upward force of the lift assist assembly. Once the slicer is lowered past the selected neutral position, gravity completes the job and the slicer moves downward without any additional required user force, until the two right feet are in contact with the surface supporting the slicer.

Using an assumption that the weight distribution of the slicer is fairly even, the lift assist assembly can be designed on the assumption that the lift assist assembly will have to hold up approximately one half of the weight of the slicer when the slicer is tilted to its most upward position. If the most upward position is an edge lift height of about four inches, a neutral crossover point could, for example be set at about two inches, at which point the lift assist assembly will exert enough upward force to continue moving the slicer upward to the most upward position, as limited by the extension length of the gas spring. Push down force to move the slicer back down can be analyzed in a similar way.

The lift assist assembly reduces the total user input energy required to lift the slicer to its upward tilted position, and also supports/holds the slicer in such position until the user pushes the slicer back down.

Figure 7:
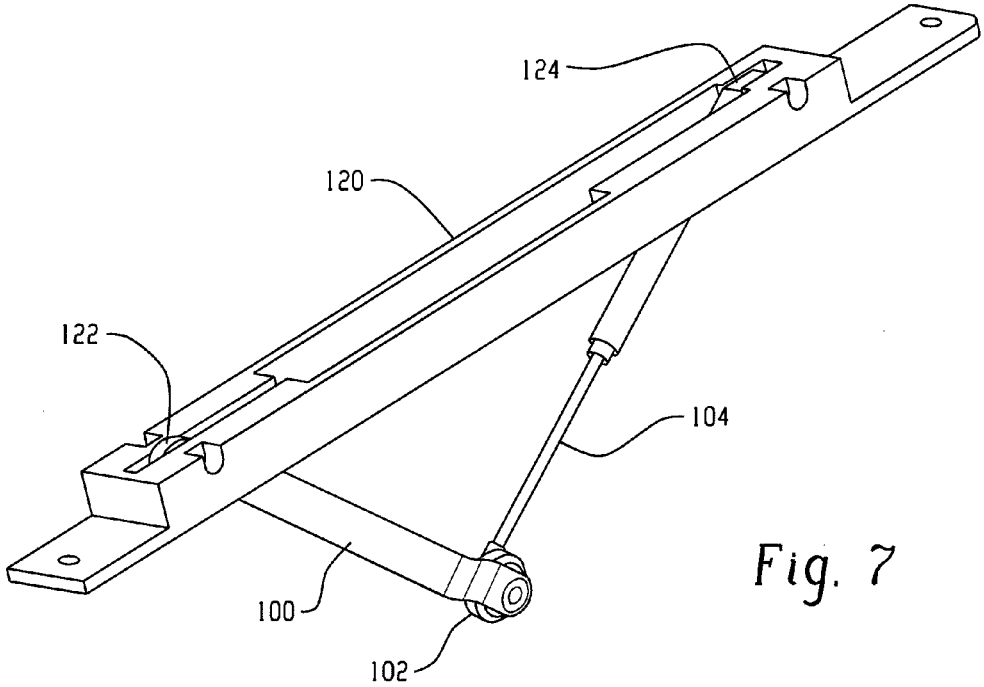
FIGS. 7 and 8 show an alternate arrangement of a lift assist assembly.
Figure 8:
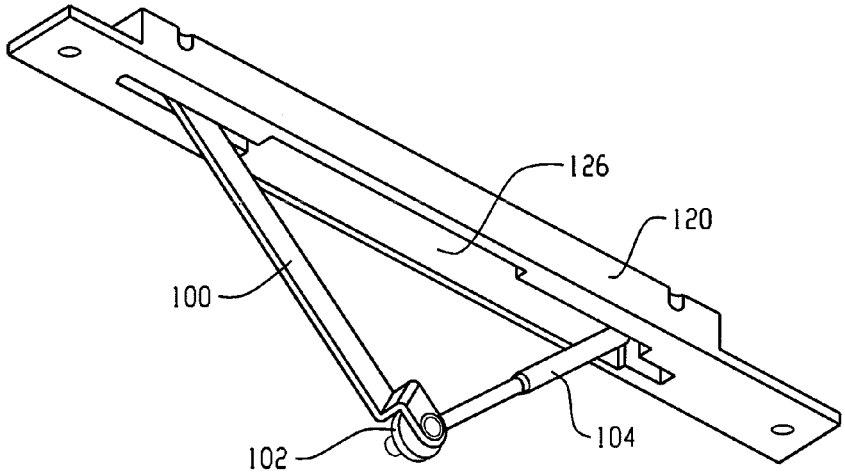

Referring now to FIGS. 7 and 8, an alternative lift assist arrangement is shown, where a single mounting bracket 120 is provided, with linkage bar 100 and gas spring 104 pivotally connected thereto at respective locations 122 and 124. A lower side of the bracket 120 includes a slot 126 (which may be a through slot) for allowing portions of the linkage bar 100, roller 102 and gas spring 104 to move therein when the slicer is in a down position. The mounting bracket may be formed as a separate piece, or may be formed unitary with the underside of the base (e.g., as part of a metal casting or as part of a molded plastic piece).

Notably, in either of the embodiments, the entire lift assist assembly can be located inboard of the footprint of the slicer base. The gas spring operates to store/absorb the energy when the slicer is pushed down from the up position. In addition, while a gas spring is primarily described, other spring assist arrangements could be used, such as an extendable mechanism that relies solely on a mechanical spring to store and release energy to provide the lift assist.

Figure 9:
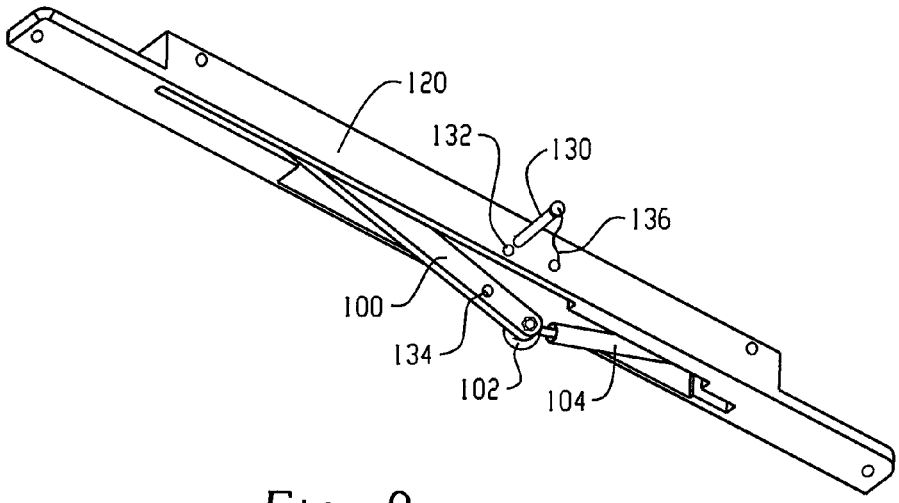
FIG. 9 shows a lift assembly with a mechanism for latching the lift unit upward in a stowed position when not in use.

It is to be clearly understood that the above description is intended by way of illustration and example only and is not intended to be taken by way of limitation. Other changes and modifications could be made. For example, a powered lift assist assembly could be provided by the use of a linear actuator or other like component that is operated via a user input key or button. In addition, a latch may be provided for holding the lift assist assembly in a stowed position up against the underside of the slicer body when not in use. For example, FIG. 9 shows a pin 130 latch arrangement and associated alignable openings 132 and 134 between the bracket 120 and the linkage 100. The pin may include a tethered attachment 136 to the bracket 120 as shown to avoid loss. Other latch arrangements could also be used.

What is claimed is:

1. A food product slicer, comprising:

a base;

a knife mounted for rotation relative to the base;

a carriage mounted to the base for reciprocal movement back and forth past a cutting edge of the knife; and a lift assist assembly associated with the base and arranged to provide an upward force to push the slicer upward toward an upward tilted position, whereby the upward force is additive with user input energy required to tilt the slicer upward, such that the lift assist assembly reduces the user input energy required to tilt the slicer upward;

wherein the lift assist assembly includes a first linkage with a first end pivotally connected to the base, an extendable spring assist linkage with a first end pivotally connected to the base, and a roller, a second end of the first linkage pivotally connected to the roller, a second end of the extendable spring assist linkage pivotally connected to the roller.

2. The slicer of claim 1 wherein the extendable spring assist linkage is an extendable gas spring that is in a compressed condition when the slicer is resting horizontal and that extends when the slicer is tilted upward.

3. The slicer of claim 1 wherein the first linkage has a fixed length.

4. The slicer of claim 1 wherein the lift assist assembly is arranged such that an upward lifting force provided by the lift assist assembly increases as the slicer is tilted upward.

5. The slicer of claim 4 wherein the lift assist assembly is arranged such that when the slicer tilt height is below a selected neutral crossover height, the lift assist assembly provides insufficient force to hold the slicer up, and when the slicer tilt height is above the selected neutral crossover height, the lift assist assembly provides sufficient force to hold the slicer up.

6. The slicer of claim 1 wherein the entire lift assist assembly is located inboard of a footprint of the slicer base.

7. A food product slicer, comprising:

a base;

a knife mounted for rotation relative to the base;

a carriage mounted to the base for reciprocal movement back and forth past a cutting edge of the knife; and a lift assist assembly associated with the base and arranged to push the slicer upward toward an upward tilted position, the lift assist assembly arranged for reducing user input energy required to tilt the slicer upward;

wherein the lift assist assembly includes a first linkage with a first end pivotally connected to the base, an extendable spring assist linkage with a first end pivotally connected to the base, and a roller, a second end of the first linkage pivotally connected to the roller, a second end of the extendable spring assist linkage pivotally connected to the roller.

* * * * *